United States Patent [19]

Culver

[11] 4,006,674

[45] Feb. 8, 1977

[54] HUMIDIFIERS FOR FORCED AIR SYSTEMS

[76] Inventor: Charles V. Culver, 729 Mingus Ave., Prescott, Ariz. 86301

[22] Filed: Apr. 14, 1975

[21] Appl. No.: 552,427

Related U.S. Application Data

[63] Continuation-in-part of Ser. No. 418,784, Nov. 23, 1973, abandoned.

[52] U.S. Cl. ..... 98/105; 55/226; 55/246; 55/260; 261/62; 261/DIG. 15; 98/109

[51] Int. Cl.[2] ..... F24F 13/00

[58] Field of Search ..... 98/109, 105, 12, 17, 98/30, 100; 126/113, 134, 313; 261/119 R, DIG. 15, 62; 55/244, 226, 246, 260, 309

[56] References Cited

UNITED STATES PATENTS

| | | | |
|---|---|---|---|
| 99,864 | 2/1870 | Ebert | 98/105 |
| 2,162,394 | 6/1939 | Whiteley | 126/113 X |

FOREIGN PATENTS OR APPLICATIONS

| | | | |
|---|---|---|---|
| 615,539 | 3/1933 | Germany | 126/113 |

*Primary Examiner*—William F. O'Dea
*Assistant Examiner*—William E. Tapolcai, Jr.

[57] ABSTRACT

A humidifier for use in forced air heating systems is provided wherein a housing having a water reservoir therein is adapted to be positioned adjacent an air register, outlet or diffuser. A duct in communication with said air register is provided within the housing for delivery of air to the water reservoir, and a flexible curtain or baffle is positioned within the housing across said duct and extending into the water of said reservoir. This arrangement requires the forced air entering said duct to flex, balloon or bow out the curtain to raise it above the water surface in order to escape to the outside. The device is adaptable to forced air floor, wall or overhead registers, outlets or diffusers.

10 Claims, 6 Drawing Figures

Forced Air Duct
Air Flow

HUMIDIFIERS FOR FORCED AIR SYSTEMS

This application is a continuation in part of my pending application Ser. No. 418,784 filed Nov. 23, 1973, now abandoned.

BACKGROUND OF THE INVENTION

Humidifiers for use with hot air registers have long been known. They have involved the use of porous wick materials, air-directing baffles to direct the air over the surface of water, and shower or spray systems for achieving contact between the air and the water. While such humidifier devices have succeeded in imparting some additional water to heated air, most have been designed for use with gravity-type hot air systems. There remains a need for compact units specifically designed for forced air systems whereby greater moisture content may be imparted to the air.

SUMMARY OF THE INVENTION

It is an object of the present invention to provide a humidifier for forced air systems which enables more intimate contact between the air and water to effect substantially greater humidification.

Another object of the present invention is to provide such a humidifier which is portable and may be moved from one air outlet to another as desired.

A further object of the present invention is to provide a relatively simple humidifying device having no wearable moving parts and which may be constructed economically.

The present invention provides such a humidifier comprising a housing having a water reservoir therein. A duct or passageway in communication with the air outlet is provided for delivery of air to the water reservoir, and a thin, flexible and substantially air-impervious curtain or baffle is positioned within the housing so as to extend into the water, thereby requiring the forced air to flex, balloon or bow out the curtain to raise it above the water surface to escape to the outside.

Figures 1, 2, 3:
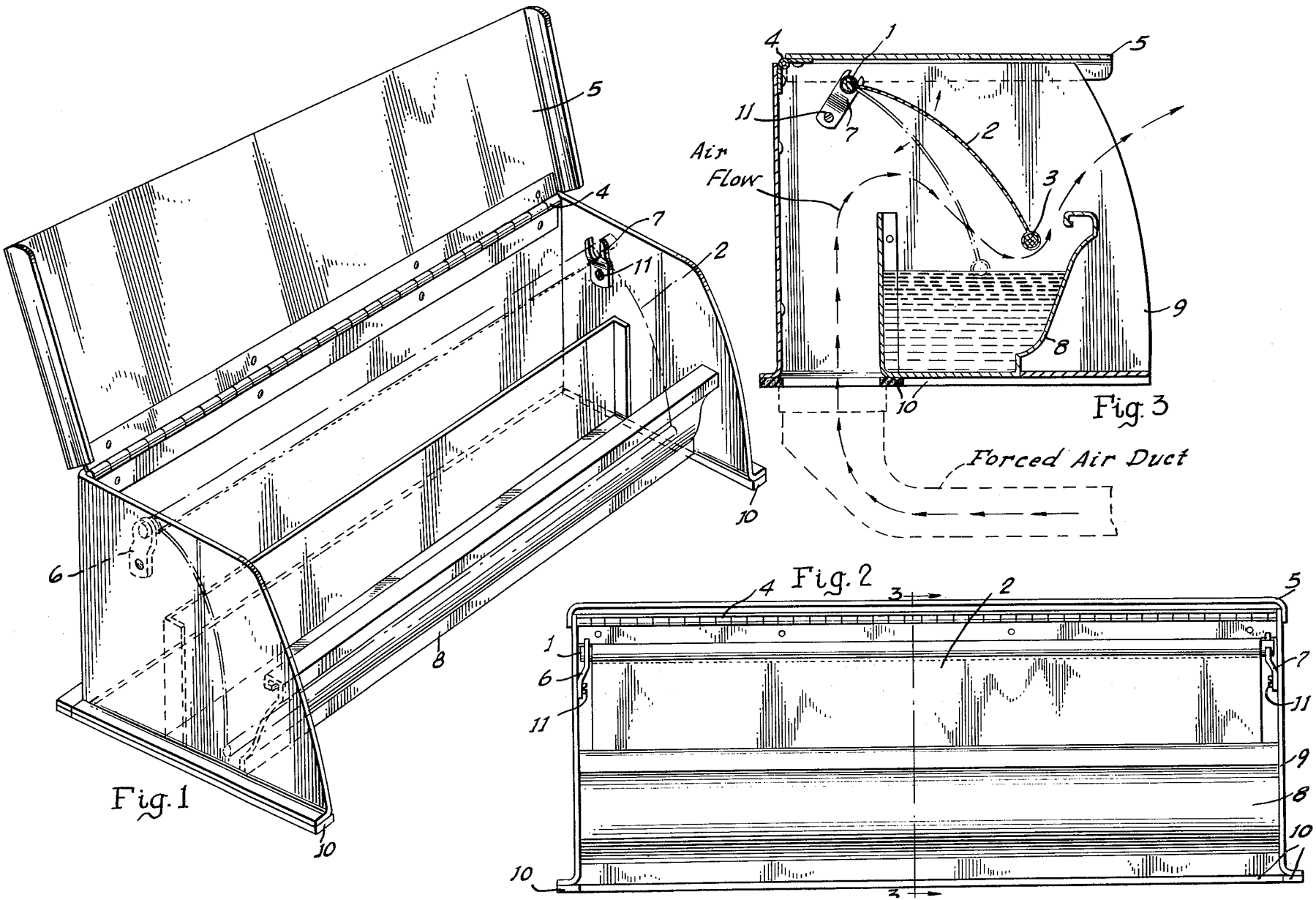
FIG. 1 is a perspective view of a humidifying device constructed in accordance with the present invention, showing the lid in open position.
FIG. 2 is a front elevational view of the humidifier of FIG. 1 with the lid in closed position.
FIG. 3 is a cross-sectional view taken along line 3—3 of FIG. 2.

In the drawings, 9 indicates a rectilinear housing structure for a humidifier having a water reservoir 8. The entire structure can be made of any suitable material such as sheet metal, plastic or the like. The housing is provided with a lid 5 suitably hinged or otherwise positioned upon and/or secured to the body of the housing 9. Between the water reservoir 8 and the back wall of the housing is an air duct for communication with a forced air outlet or register in a floor, as shown in FIG. 3. This duct delivers the forced air to the air inlet of the curtain chamber now to be described. A thin, flexible and substantially air-impervious curtain or baffle 2 extends the width of the housing and is supported near the top of the housing by means of a rod 1 extending between the side walls thereof and carried on adjustable supports 6 and 7. The flexible curtain 2, preferably made of plastic material or if desired of sailcloth, sheer synthetic curtain material or the like, is weighted at its lower edge, as by a rod 3 or the like. When there is no air flow through the device, the lower edge of the curtain will be below the surface of the water in the reservoir 8.

The support rod 1 for the curtain 2 is preferably adjustable toward and away from the lid 5, as by being mounted on supports 6 and 7 which are pivotally attached to the side walls of the housing by pivot pins 11,11. Such adjustment of the rod permits more or less of the forced air to by-pass the curtain, as may be desirable under circumstances discussed more fully hereinafter. As shown in FIG. 3, most of the forced air entering the curtain chamber must flex, balloon or bow-out the curtain in order to escape to the outlet of the device, since this action on the curtain raises at least a part of the weighted edge of the curtain above the surface of the water in the reservoir 8. In operation, the curtain 2 alternately and gently assumes the position shown in dotted lines and somewhat of the position shown in solid lines to produce a fluttering motion; that is, a gentle and smooth up-and-down in-and-out rocking or pulsing of the weighted edge of the curtain, which action is turn creates gentle agitation and wave motion in the water. The air is thus forced into intimate pulsating contact with agitated water, to thereby secure greater humidification. It should be noted that when air escapes from behind the curtain by passing under the slightly raised weighted edge thereof it continues in an upwardly direction in reaching the air outlet of the curtain chamber. This upward travel of the air acts as a buffer to keep the weighted edge of the curtain in rocking motion and centered in the trough of the water reservoir. This upward travel of the air also assists in keeping the weighted edge of the curtain from striking the inwardly-curved lip of the reservoir, even when the curtain is deep enough to do so when it is stretched tight from the rod 1 toward the said lip.

Aerodynamically, the ballooning of my flexible curtain creates a system exhibiting forced vibration due to the interplay of balanced air pressures and a compliant member (the curtain) which possesses inertia. When the air pressure rises sufficiently to raise the weighted edge of the curtain above the water, the air pressure on the curtain drops slightly and the curtain gently falls back into the water. The system then begins to pulsate or vibrate gently at a low and fairly steady rate, imparting a gentle agitation to the water. Moreover, the balanced air pressure of the system tends to keep the curtain centered over the reservoir, so that the curtain does not undergo twisting or sidewise movement causing impingement of the end(s) of the weighting rod against the housing. Accordingly, the pulsating action of the curtain creates no sidewise hammering action causing noise, and the whole operation remains noiseless.

EXAMPLE 1

A humidifier conforming to the attached drawings has a height of 5 inches, an inside width of 13⅞ inches and a rectangular curtain measuring 6 × 13½ inches. The supporting rod 1 is ⅜ inch in diameter and is positioned so that its highest point is 3/16 inch below the lid 5. The curtain is made of 4 mil polyethylene sheeting and weighs 8.5 grams. The weighting rod 3 is ⅜ inch in diameter and weighs 31 grams. When the humidifier is placed over a floor diffuser having a forced air flow of about 94 cfm., the curtain promptly exhibits noiseless pulsation and consequent gentle agitation of the water. The water in the reservoir needs to be replenished in Arizona at a rate of about 1 pint per 12 hours.

EXAMPLE 2

When the weighting rod of Example 1 is replaced with a rod weighing 11 grams, it is necessary to close the shutters on the diffuser so as to secure an air flow of about 64 cfm. The curtain then begins sustained and noiseless pulsation. The water replenishment rate is about the same.

EXAMPLE 3

When the polyethylene curtain of Example 1 is replaced with a similarly dimensioned curtain made of muslin, substantially no differences in operation are observed except that the muslin, in a period of about a month, acquires a stiffening deposit of salts from the water in the reservoir, and therefore needs to be replaced or removed and washed.

From the foregoing description of the invention, it will be understood that my humidifier undergoes the characteristic gentle pulsation automatically when the air flow and the weighting of the curtain are properly adjusted. A proper adjustment for a diffuser which is located near the blower in a forced air system may not be optimum for a diffuser located farther from the blower, due to drop in pressure caused by the longer duct. It is for this reason that the support rod 1 is carried by adjustable supports 6 and 7. By rotation of the supports about pivot pins 11,11, the rod 1 can be moved closer to or farther from the lid 5, thereby varying the width of the opening between them. This opening by-passes more or less of the forced air, and in turn varies the total force of the air acting on the curtain.

For grosser adjustments, such as may be needed for systems operating at higher than normal air flow, one way is to replace the weighting rod 3 with a slightly heavier rod. If the original rod was buoyant, such as a wooden dowel or a plastic rod, replacement with a non-buoyant rod of about the same weight may be sufficient. Another way to secure the needed adjustment is to replace, say, a polyethylene curtain, which is air-impervious, with a woven curtain which is somewhat air-pervious, e.g. a curtain of woven water repellent synthetic fiber. Adjustments can also be made by replacing a tightly woven curtain with one having a looser weave (larger openings between threads). The principle involved here is that some measure of proper adjustment can be secured by by-passing a small part of the excess forced air through the curtain itself. Referring to FIG. 3, the resilient gasket 10 around the perimeter of the air duct of the housing helps prevent escape of air through the joint. However, under circumstances where the air flow is excessive and some venting is desired, said gasket can be omitted, or there can be intentional misalignment between the outlet of the heating system and the air duct opening of the humidifier. Other means for venting excess air are illustrated in FIGS. 4–6.

In the normal use of my humidifier, one aim is to have the capacity of the water reservoir large enough so that the evaporated water can be replaced only twice a day, say, morning and night. To this end it is desirable that the weighted edge of the curtain be on or close to the bottom of the reservoir. In this way, as the water evaporates and the water level lowers, the edge of the curtain will remain in water. Ballooning of the curtain under the pressure of the forced air then takes the slack out of the curtain and pulls the weighted up upstream somewhat. However, when the reservoir is full under these circumstances, the weighted edge of the curtain performs its gentle pulsations in an area close to the air outlet opening of the humidifier, and the pulsations may actually flip drops of water out said opening. To overcome this, as well as to secure other advantages, I provide a curtain as shown in FIG. 4. The curtain 2 is there shown in the position it assumes when there is no air flow through the humidifier. The curtain 2 is wide or deep enough that the weighted edge hangs near the bottom of the reservoir 8. However, in this embodiment, the weighted bottom edge of the curtain is made in two symmetrical sections 12, 12, each of which is separately weighted with rods 13, 13 or the like. Between the inside ends 14, 14 of the weighting rods is a shallow opening 15 made by cutting out the lower portion of each rod for a distance of e.g. ½–1 inch back from said ends. Also the curtain 2 has a cut or narrow slot 16 in the center extending upwardly a distance of e.g. ⅓ to ½ of the total depth of the curtain. This structure of the curtain provides a small but continuous by-pass of forced air through the opening 15 but also, in effect, divides the curtain into two symmetrical sections 12, 12 each of which is independent of the other in its behaviour as a forced vibratory system. The operational effect of the so-structured curtain is to allow the force of the air to press the center of the lower part of the curtain forward relative to the sides, in a very shallow V formation. This elevates the center slightly more than the sides, so that the sides make more contact with the water. The result is a smoother pulsating action, and this helps avoid the spilling of droplets of water over the front lip of the reservoir, which lip in itself retards splashing somewhat. The curtain structure also benefits the curtain action where the base of the humidifier is out of level (one side higher than the other). In tests, the pulsating action operates in the normal manner even when one side of the humidifier is elevated as much as ¾ inch above the other side.

Figure 4:
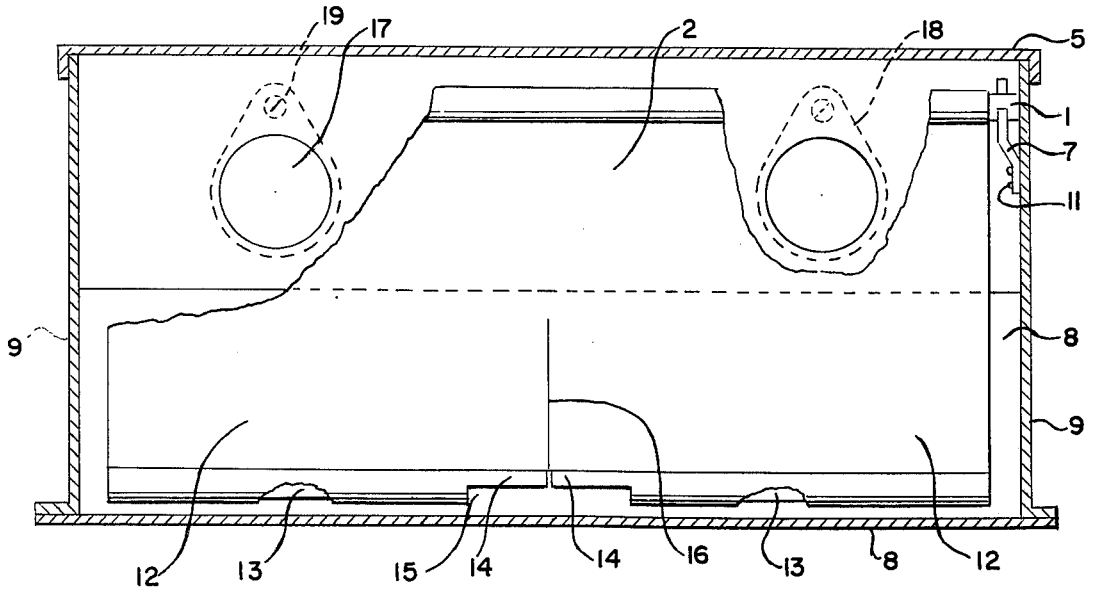
FIG. 4 is a vertical sectional view corresponding to FIG. 2 with portions broken away for clarity, and showing a curtain modified in accordance with one embodiment of the invention and also showing vent openings in the back wall of the housing.
Figure 5:
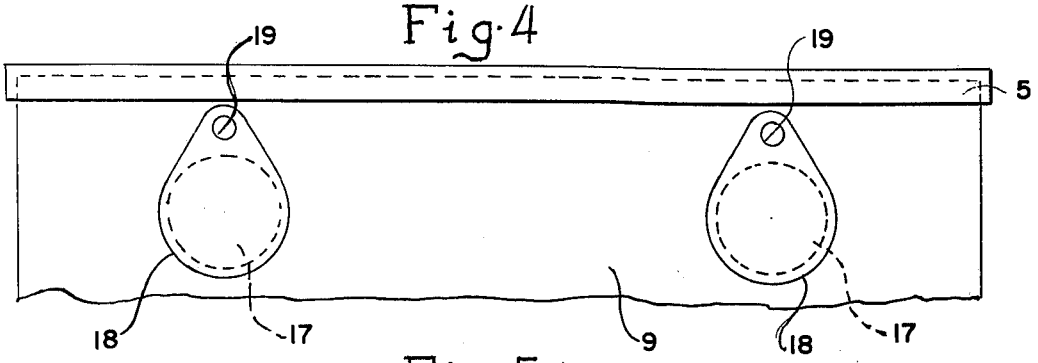
FIG. 5 is a fragmentary elevational view of the back wall of the housing of FIG. 4.

FIGS. 4 and 5 also show adjustable vent openings 17, 17 over which are disposed cover plates 18, 18. Each cover plate is attached to the housing's back wall by a screw 19. The said vent openings are normally closed with the cover plates, but in an installation were the forced air flow is excessively high, proper operation of the humidifier can be secured by opening one or more of the vents by swinging a cover plate aside and clamping it in position with the screw. It will be understood that such venting of excess air occurs before the remainder of the air enters the inlet to the curtain chamber, thereby lowering its volume and pressure within said chamber.

Figure 6:
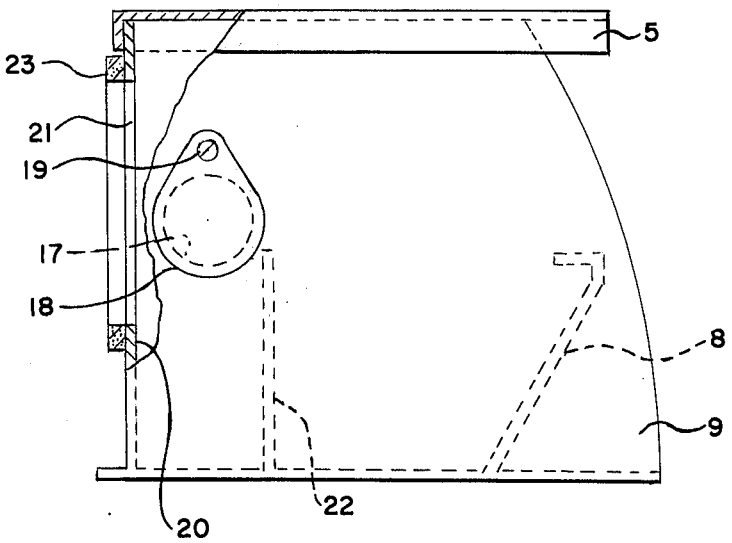
FIG. 6 is an end elevational view of a humidifier housing adapted for communication with a wall outlet of a heating system, a portion being broken away for clarity.

Referring now to FIG. 6, this end view is of a humidifier housing like that of FIGS. 1–3 with two differences.

The back wall 20 provides an opening 21 for communication with a wall outlet or diffuser of a heating system. A resilient gasket 23 is positioned around the perimeter of said opening. A pair of vent openings are provided on the ends of the housing, one being shown in this view. The vent opening 17 is normally covered with cover plate 18, which in turn is attached to the housing 9 by a screw 19, all as explained above in connection with FIGS. 4 and 5. It will be noted that the vent opening is disposed in the housing so as to be between the rear wall 22 of the reservoir 8 and the back wall 20 of the housing. The vents are thus positioned ahead of the air inlet to the curtain chamber, which is the opening between the top of wall 22 and the surrounding housing.

As will be understood from the foregoing descriptions of the drawings, my humidifer housings are preferably provided with a lid which can be swung out of the way or removed entirely. This is to permit easy access to the interior for replenishing water, making adjustments of the curtain supports, for occasional cleaning of the curtain and the reservoir, or for replacement of the curtain with another.

Now that I have described my invention, it will be clear that the herein described pulsating movement of the weighted edge of the curtain plus the resulting agitation of the water unite in causing improved contact between the forced air and the agitated water, in providing better humidification, and in advancing the art over previous humidifiers that embody nonfluctuating deflectors which merely direct the air over the surface of quiet water. Such art, generally being designed specifically for gravitational hot air systems, lacks the proficiency of the present invention, if an attempt is made to adapt it to a forced air system.

From the foregoing description of my invention it will be clear that the principles of the invention are equally applicable to humidifiers for floor, wall, or overhead air outlets by suitable repositioning of the opening in the housing which communicates with the outlet, as will be apparent to those skilled in the art. The main principle is that the air inlet and the air outlet of the curtain chamber are positioned in the housing relative to the reservoir so that the main passageway for forced air between said air inlet and outlet passes over the water. A curtain can then be suspended in said passageway so as to substantially block said flow of air and yet have its lower weighted edge extending into the water.

As will be apparent, the reservoir may contain deodorizer and/or disinfectant material for dispersal into the room. It will be understood that the humidifiers of the invention can be adapted to any forced air system when designed to conform to the shape and dimensions of any particular air outlet of said system.

I claim:

1. A humidifier comprising (A) a housing having an air inlet opening for communication with a source of forced air, an air outlet opening, and a water reservoir positioned therebetween with the water level thereof defining with the interior of said housing a rectilinear and main passageway for air between said air inlet and said air outlet, and (B) a thin, flexible and substantially air-impervious curtain mounted on a rectilinear support and (a) suspended from said support within and across said passageway upstream from said air outlet to constitute a freely-moving barrier substantially blocking air flow between said air inlet and said air outlet, and (b) having at least symmetrical portions of its lower edge weighted rectilinearly and adapted to extend into said reservoir beneath the water level thereof, whereby forced air entering said air inlet balloons and flexes said curtain to gently and pulsatingly elevate at least a part of its lower edge above the water surface in order to escape to said air outlet.

2. A humidifier as claimed in claim 1 wherein the air outlet side of said reservoir has a lip which extends inwardly over said water.

3. A humidifier as claimed in claim 2 wherein the entire lower edge of said curtain is weighted.

4. A humidifier as claimed in claim 3 wherein said lower edge of said curtain hangs close to the bottom of said reservoir.

5. A humidifier as claimed in claim 3 wherein said lower edge of said curtain rests on the floor of said reservoir.

6. A humidifier as claimed in claim 2 wherein said curtain is severed centrally thereof by a cut extending upwardly from said lower edge a distance between about ⅓ and ½ of the total depth of said curtain, wherein the lower edge of said curtain has a shallow opening therein symmetrically positioned around said cut, and wherein the remainder of each side of said lower edge is weighted uniformly.

7. A humidifier as claimed in claim 6 wherein the lower edge of said curtain hangs close to the bottom of said reservoir.

8. A humidifier as claimed in claim 6 wherein the lower edge of said curtain rests on the floor of said reservoir.

9. A humidifier as claimed in claim 1 wherein said curtain is severed centrally thereof by a cut extending upwardly from said lower edge a distance between about ⅓ and ½ of the total depth of said curtain, wherein the lower edge of said curtain has a shallow opening therein symmetrically positioned around said cut, and wherein the remainder of each side of said curtain is weighted.

10. A humidifier as claimed in claim 9 wherein said shallow opening in the lower edge of said curtain has a width between about 1–2 inches.

* * * * *